US006630101B2

(12) United States Patent
Anderson et al.

(10) Patent No.: US 6,630,101 B2
(45) Date of Patent: Oct. 7, 2003

(54) METHOD FOR PRODUCING POWDER METAL GEARS

(75) Inventors: Gary L. Anderson, St. Marys, PA (US); William J. Olson, St. Marys, PA (US)

(73) Assignee: Keystone Investment Corporation, Wilmington, DE (US)

( * ) Notice: Subject to any disclaimer, the term of this patent is extended or adjusted under 35 U.S.C. 154(b) by 0 days.

(21) Appl. No.: 09/930,911

(22) Filed: Aug. 16, 2001

(65) Prior Publication Data

US 2003/0035747 A1 Feb. 20, 2003

(51) Int. Cl.[7] ..... B22F 3/16; B22F 3/24

(52) U.S. Cl. ..... 419/25; 419/26; 419/28; 419/29; 419/54; 419/55

(58) Field of Search ..... 419/28, 29, 26, 419/54, 25, 55

(56) References Cited

U.S. PATENT DOCUMENTS 4,006,016 A * 2/1977 Zambrow et al. ..... 75/221
4,018,632 A * 4/1977 Schmidt ..... 148/126
5,628,045 A 5/1997 Lindner et al.
5,682,588 A 10/1997 Tsutsui et al.
6,044,555 A 4/2000 Jacob et al.
6,338,747 B1 * 1/2002 Kosco ..... 75/243

OTHER PUBLICATIONS

DIN 3692, Parts 1–3 (Aug. 1978).

ASM Handbook, vol. 16, *Machining*, Copyright 1989: "Gear Manufacture", pp. 330–355.

* cited by examiner

*Primary Examiner*—Daniel J. Jenkins
(74) *Attorney, Agent, or Firm*—Kirkpatrick & Lockhart LLP

(57) ABSTRACT

A method of producing a gear from a metallurgical powder includes molding at least a portion of the powder to provide a gear preform. The gear preform is sintered and hot formed, and subsequently may be carburized. The gear preform is resintered and cooled at a cooling rate suitable to provide a bainitic microstructure in at least a surface region of the preform. The gear teeth of the preform may be shaved to, for example, adjust dimensions, and enhance dimensional uniformity.

26 Claims, 3 Drawing Sheets

METHOD FOR PRODUCING POWDER METAL GEARS

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to methods for producing gears through consolidation of metallurgical powders. The present invention also relates to gears produced by such methods. Gears that may be produced by the method of the present invention include, for example, straight gears, helical gears, pinion gears, ring gears, and spur gears.

2. Description of the Invention Background

The production of articles, including gears, from metallurgical powder is well known. Such articles are commonly referred to as "powder metal" articles. Metallurgical powder includes one or more alloyed and/or unalloyed metal powders. Metallic and/or non-metallic additives also may be included. In the usual case, combinations of metal powders and optional additives are mixed to provide a generally homogenous powder blend. A portion of the powder blend is disposed in a mold cavity. The mold cavity has the shape of the desired preform and, for example, may be a simple cylindrical shape or a complex shape approximating the desired final part shape. Pressure is applied to consolidate the metallurgical powder and create a green preform. The preform may then be sintered to fuse the powder particles and increase the density of the compact. In some cases, the sintered part may be in a final form. Typically, however, the sintered part is subjected to one or more closely controlled steps of additional processing to increase part density to more closely approach theoretical full density, impart desired mechanical properties, and/or adjust part dimensions. Possible additional processing techniques include, for example, repressing, resintering, sizing, coining, shot peening, grinding, rolling, and heat treating.

In many cases, parts that may be formed by powder metal techniques also may be formed by machining wrought material (i.e., material prepared by cooling molten material). Various machining techniques may be used to form gears form wrought material. As described in Volume 16, "Machining", of the ASM Handbook (ASM International 1989), possible machining techniques for producing gear tooth configurations on wrought gear blanks include milling, broaching, shear cutting, hobbing, gear shaping, and rack cutting. Milling, hobbing, shaving, honing, grinding, and rack cutting are techniques commonly used for producing teeth on helical gears.

Hobbing is a generating process in which both the cutting tool and the workpiece revolve in a constant relation as the hob is fed across the face width of the gear blank. The hob is a fluted worm with form relieved teeth that cut into the gear blank in succession, each in a slightly different position. Instead of being formed in one profile cut, as in milling, the gear teeth are generated progressively by a series of cuts. Hobbing is extensively used for forming the teeth of helical gears. The rotation of the workpiece is retarded or advanced, through the action of the cutting machine differential, in relation to the rotation of the hob, and the feed is also held in definite relation to the workpiece and the hob. The extent by which the workpiece is retarded or advanced depends on the desired helix angle.

A conventional technique for producing external helical gears is schematically shown in FIG. 1. The method includes cutting to length wrought steel bar stock, forging toroidal gear blanks from the individual sections, machining the internal diameter, hobbing helically disposed gear teeth on the outer surface of the gear blanks, and then either shaving or rolling the teeth to adjust the dimensions and increase the uniformity of the gear teeth. The gears may then be heat treated and tempered to improve hardness and, possibly, other mechanical properties. The internal diameter is then ground. Grinding, honing, or lapping techniques may then be used to further improve the quality of the gear teeth. Honing of steel gear teeth is often used to remove nicks and burrs, to improve surface finish, and to make minor corrections in tooth shape. Lapping may be used for sets of hardened steel gears that must run quietly.

A level of quality may be assigned to a gear based on the DIN classification system. A classification system for assigning a whole number grade to the level of dimensional accuracy of cylindrical gears is provided in DIN standard 3962. DIN 3962 assigns lower grade numbers to gears having smaller deviation in dimensional characteristics, such as face width and face diameter, that may affect the gear's alignment with mating parts. The quality grade "1" is assigned under DIN standard 3962 to cylindrical gears having the smallest deviation in those characteristics. Thus, cylindrical gears of a particular grade based on the DIN 3962 standard may be produced by setting allowable manufacturing tolerances in line with DIN standards. Those of ordinary skill may readily determine the grade number for a particular cylindrical gear under the DIN 3962 standard by measuring deviations in the relevant gear characteristics or by knowing the tolerances for those characteristics applied during gear manufacture.

One known process for manufacturing external helical gears for automotive applications from wrought steel bar stock includes the above-described sequence of steps. A steel commonly used in that process includes, in weight percentages, 0.18–0.22 iron, 0.60–0.95 manganese, 0.15 max. silicon, 0.35–0.75 nickel, 0.35–0.65 chromium, 0.015–0.045 aluminum, 0.15–0.25 molybdenum, and incidental impurities. As indicated in FIG. 1, gears resulting after the teeth of the hobbed gear blank are shaved qualify as grade 7 based on a comparison of the DIN 3962 standard and the dimensional deviations present in the shaved gear. If the hobbed gear teeth are rolled rather than shaved, then under the DIN 3962 standard the rolled gear typically qualifies as grade 8. The higher grade number indicates that there is somewhat more dimensional deviation in external helical gears produced by rolling. Heat treating the hobbed or shaved gears introduces stresses that affect the dimensional variability of the gears and increases the DIN 3962 grade, usually to grade 9. In applications requiring higher dimensional accuracy and, conversely, lower alignment deviation, the heat-treated gear teeth may be honed to increase the DIN 3962 quality of the gears to about grade 7. If even greater dimensional accuracy is required for a particular application, the time-consuming step of grinding the teeth may increase the DIN 3962 quality to grade 5–6.

In general, the machining steps required to form the teeth and internal diameter of gears produced from wrought material are costly and time consuming. Finishing treatments applied to adjust the dimensions and reduce the dimensional variability of the gear teeth, such as honing and grinding, are particular costly. Applying such finishing treatments to non-linear gears, such as helical gears, is particularly costly, may require the use machinery that is specialized to accommodate the geometry of the gears, and adds significant processing time.

Accordingly, the need exists for a method of economically manufacturing high quality helical gears and other types gears.

BRIEF SUMMARY OF THE INVENTION

In order to address the above-described needs, the present invention provides a novel method for producing gears from an iron-base metallurgical powder that is an alternative to producing the gears from wrought bar stock. The method includes molding at least a portion of the iron-base metallurgical powder to provide a gear preform, and subsequently sintering the gear preform to form a sintered preform. The gear preform is subsequently hot formed, and is carburized in a later step to introduce carbon into at least a surface region of the preform. The gear preform is subsequently resintered and is then cooled at a cooling rate that provides a bainitic microstructure in at least a surface region of the preform. If desired, the gear preform may then be shaved to adjust the dimensions and increase uniformity of the gear teeth.

The present invention also addresses the above-described need by providing a method for producing a gear from a metallurgical powder wherein a gear preform is provided by molding at least a portion of an iron-base metallurgical powder in a gear-shaped mold cavity. The green preform is subsequently sintered. In a later step, the gear preform is hot formed. The hot formed preform is subsequently resintered and is then cooled so as to provide a bainitic microstructure in at least a surface region of the preform. The preform must include sufficient carbon and/or suitable alloying additions so that the desired bainitic structure will result on cooling at an appropriate rate after being held at the resintering temperature. Carbon may be introduced into the preform through a carburizing or equivalent operation, or suitable carbon levels may be provided in the original metallurgical powder so that a carburizing operation or an equivalent operation is unnecessary. The gear teeth of the preform are then shaved to provide a dimensionally improved gear.

Although the foregoing passages generally describe methods considered to be within the present invention, it will be understood that the methods may include additional steps. Such additional steps may be, for example, intermediate and/or downstream of the described steps.

The present invention is also directed to gears such as, for example, external straight gears and external helical gears, produced by the methods of the present invention. More fundamentally, the present invention is directed to gears produced by a powder metal manufacturing method and wherein at least a surface region of the gear preform has a bainitic microstructure. The invention also is directed to articles of manufacture including one or more of such gears. Such articles of manufacture may include, for example, engines, automatic transmissions, four wheel drive transfer cases, and riding lawnmower transmissions.

The methods of the present invention may be used to form gears of any type, including, but not limited to, straight gears, helical gear, pinion gears, ring gears, and spur gears. The present invention's methods are particularly suited to producing external gears such as external straight gears and external helical gears. Gears produced by methods according to the present invention may be of high quality, qualifying as DIN grade 5 or better under the DIN 3962 standard, immediately after a step of shaving the gear teeth and without grinding, honing, or other surface finishing steps. The powder metal methods of the present invention may require fewer steps and less manufacturing cost than certain conventional methods of producing gears for like applications.

The reader will appreciate the foregoing details and advantages of the present invention, as well as others, upon considering the following detailed description of embodiments of the invention. The reader also may comprehend additional advantages and details of the present invention upon carrying out or using the invention.

BRIEF DESCRIPTION OF THE DRAWINGS

The features and advantages of the present invention may be better understood by reference to the accompanying drawing in which.

DETAILED DESCRIPTION OF EMBODIMENTS OF THE INVENTION

The present invention is directed to methods for producing gears from iron-base metallurgical powders. As used herein, "metallurgical powder" refers to a substantially homogenous powder including a single alloyed or unalloyed metal powder or a blend of one or more such powders and, optionally, other metallurgical and non-metallurgical additives such as, for example, lubricants. Thus, "metallurgical powder" may refer to a single powder or to a powder blend. Also as used herein, an "iron-base" metallurgical powder is a powder in which the total weight of iron and iron alloy powder is at least 50 percent of the powder's total weight.

Embodiments of methods within the present invention provide numerous advantages relative to certain conventional methods for producing gears by machining of wrought metallic materials. Chief among those advantages are a reduction in the cost associated with the various processing steps necessary to produce a gear of given quality. As an example, the inventors have produced powder metal external helical gears of grade 5 quality (assessed under the DIN 3962 standard) using a method within the present invention having fewer steps and at significantly lower cost than is produced by the conventional non-powder metal method illustrated in FIG. 1 and described above. As further described below, DIN 3962 quality grade 5 external helical gears have been produced from iron-base metallurgical powder by a method within the present invention upon shaving the gear teeth following a resinter and cooling operation.

Although the methods of the present invention are particularly suited to producing external helical and external straight gears, the invention also may be adapted for the production of other gear types including, for example, pinion gears, ring gears, and spur gears. Thus, it will be understood that although specific embodiments described herein relate to the production of external helical gears, that description is not a limitation on the scope of the present invention as expressed in the appended claims.

Figure 2:
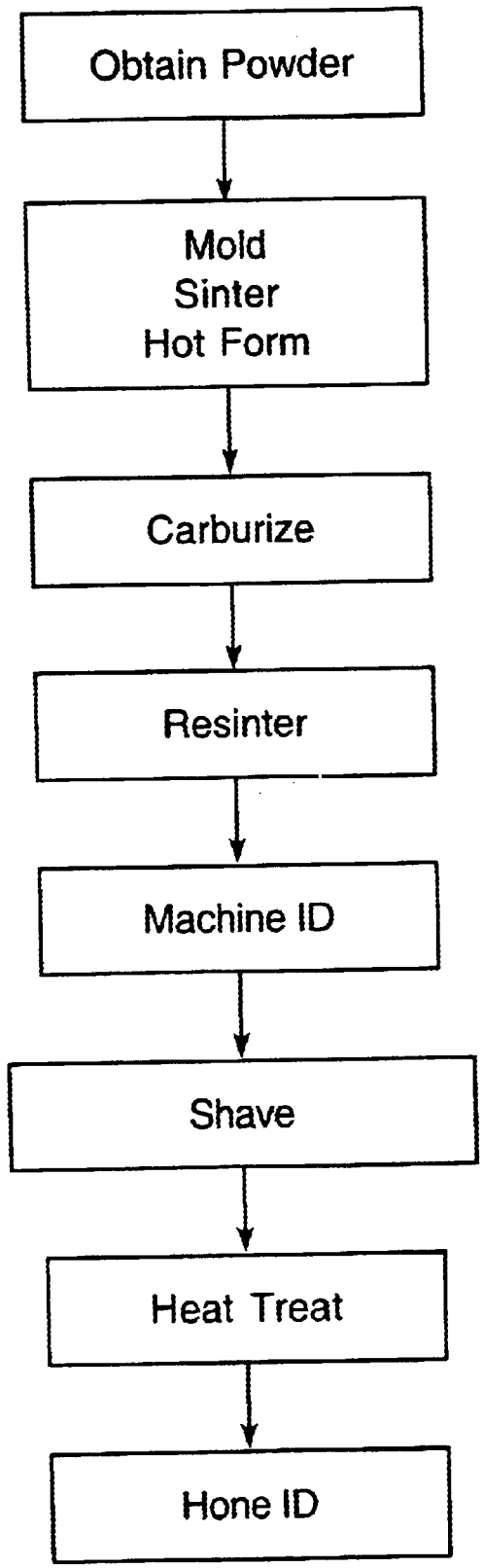
FIG. 2 is a schematic representation of an embodiment of the method of the present invention particularly adapted for producing powder metal external helical gears.

In one form, illustrated in FIG. 2, the present invention is directed to a method of forming gears from an iron-base metallurgical powder including the steps of molding, sintering, hot forming, carburizing, and resintering. Any suitable iron-base metallurgical powder may be used in the method of the present invention. The particular composition of the metallurgical powder will largely depend on the intended application and the desired mechanical properties and other characteristics of the finished gear. Those of ordinary skill in the art may readily choose suitable metallurgical powder compositions. One iron-base metallurgical powder composition particularly suited for production of external helical gears includes powder components providing the following elemental analysis, in weight percentages: 0.2 up to 0.3 carbon; 0 up to 0.2 sulfur; up to 0.03 phosphorus; 0.10 up to 0.25 manganese; 0.50 up to 0.60 molybdenum; 1.75 up to 2.00 nickel; 0 up to 0.03 silicon; 0 up to 0.10 chromium; 0 up to 0.15 copper; and greater than 50 iron.

In a first step of the method shown in FIG. 2, all or a portion of the selected metallurgical powder is disposed in the cavity of powder metal mold press and is pressed under high pressure, typically in the range of 20 tsi up to 70 tsi, to form a green gear preform. The mold press preferably includes a die cavity having the geometry of the intended article. Equipment for producing green gear preforms from metallurgical powders is readily available. Examples of such equipment and methods for its use are provided in U.S. Pat. No. 6,044,555 (hereinafter "the '555 patent") and in pending U.S. application Ser. No. 09/678,703, filed Oct. 3, 2000 (hereinafter "the '703 application"). The entire disclosure of the '555 patent and the '703 application are hereby incorporated herein by reference.

The molding method disclosed in the '555 patent includes disposing an iron-base metallurgical powder in a preform mold including a gear-shaped mold cavity and a movable member in the form of a punch member. The movable punch member impacts the metallurgical powder axially within the preform mold so as to consolidate the powder particles and provide the green gear preform. The walls of the gear-shaped mold cavity may have the gear profile of an external helical gear so that the green preform is in the shape of such a gear. In such case, the movable punch member may rotate to follow the gear teeth configuration on the mold cavity walls. The mold press may include a core rod that passes through the mold cavity and forms a bore through the gear preform as the rotating punch member axially impacts the powder. A modified form of this mold press is described in the '703 application and is adapted for the production of internal helical gears. The modified mold press includes a rotating core rod having an exterior surface with a desired gear profile. When impacting the metallurgical powder with the punch, the core rod and the punch rotate to provide a gear having a helical pattern on an inner diameter of the preform.

The green gear preform is sintered by heating in a sintering furnace, such as an electric or gas-fired belt or batch sintering furnace, for a predetermined time at high temperature. The sintering step fuses the powder particles and increases the density of the compact. Typically, the sintering temperature for iron-base compacts will be in the range of 2000° F. (1093° C.) to 2400° F. (1315° C.). The appropriate sintering temperature and time-at-temperature will depend on several factors, including the chemistry of the metallurgical powder, the size and geometry of the compact, and the heating equipment used. Those of ordinary skill in the art may readily determine appropriate parameters for the molding and sintering steps to provide a sintered gear preform of suitable density and geometry.

Although the density of the preform will vary widely depending on its composition and the particular pressing and sintering parameters employed, the average density of a sintered preform formed from an iron-base metallurgical powder typically is in the range of 6.2 to 7.2 g/cc and may be, for example, 6.8 g/cc.

Subsequent to sintering, the gear preform is cooled and then hot formed. One technique of hot forming includes first coating the sintered preform with a high temperature lubricant. The lubricated gear preform is then delivered to a preform heater where it is heated to a high temperature, typically between 1400° F. (760° C.) and 2100° F. (1149° C.), which is below the sintering temperature of the preform. Preferably, the sintered gear preform is inductively heated, although radiant heating and convection heating, for example, may be used. The heated lubricated preform is then placed within the hot forming die of a hot forming press. The die is preferably maintained at a controlled temperature, which may be, for example, about 600° F. (316° C.). The heated preform is then pressed within the heated die with sufficient force to further densify the preform. The pressure is usually about 40 tsi in this step, but can vary from 20 tsi to 90 tsi for different types of powders and parts. Preferably, the pressure exerted by the hot forming press is within the range of 50 tsi to 60 tsi because this range of pressures may prolong tool life relative to higher tonnages and also should provide the hot formed preforms with a consistent size.

Equipment for hot forming sintered powder metal compacts is generally available, and those of ordinary skill are readily capable of operating such equipment. The '555 patent discloses an example of such equipment adapted for the hot forming of sintered external helical gear preforms. The design of the hot forming equipment disclosed in the '555 patent is similar to the design of the mold press disclosed in the '555 patent, which is described above. The hot forming mold press disclosed in the '555 patent includes a die cavity, an upper portion, and a lower portion. The upper portion includes a punch that impacts the sintered gear preform. The punch has an external geometry that matches the wall of the die cavity and may enter the cavity and rotate as it impacts the preform within the die cavity. The external geometry of the punch matches the geometry of the die cavity and moves along the wall of the die cavity as it rotates. The upper portion of the die also may include a core pin to conform to the bore of the preform. After the punch impacts the preform, the hot formed preform is ejected from the die cavity by the punch. The hot formed preform will have shorter axial length than the sintered preform. Although the hot formed preform and the sintered preform will have substantially the same weight, the hot formed preform will be of greater density.

Additional equipment for hot forming sintered gear preforms is disclosed in the '703 application. The equipment disclosed in that application includes a rotating core rod having the gear profile of the internal gear, and it is particularly suited to hot forming internal helical gears.

The final density of the hot formed gear preform will depend on the impacting force applied to the preform in the hot forming die. The final density of hot formed preforms typically varies from about 7.5 to about 7.85 g/cc for iron-base metallurgical powders. A preferred sequence for performing the above-described molding, sintering, and hot forming steps is taught in the '555 patent In a subsequent step, the hot formed gear preform is carburized. The object of the carburizing step is to provide additional carbon within a surface region of the compact. Carbon is provided within the surface region so that as the preform is cooled from a resintering temperature, bainite forms in regions of the preform that may be subjected in a later step to a shaving operation. As used herein, a "surface region" refers to a region on at least a portion of a gear preform extending from the surface into the gear preform. The significance of the presence of bainite in the surface regions is discussed in greater detail below. In any case, the carburization may be carried out in any manner suitable to introduce sufficient carbon into a surface region of the preform so that bainite will form in the surface region upon resintering the preform and cooling it at an appropriate rate. Those of ordinary skill may, without undue experimentation, determine suitable parameters for carburizing a particular preform so as to introduce sufficient carbon into the preform.

Certain carburizing processes involve heating the preform at high temperature in a carbon-containing gaseous atmosphere or in a packing of a carbonaceous material so as to promote solid state diffusion of carbon into the preform. The heating temperature is typically in the range of 1400° F. (760° C.) to 2400° F. (1316° C.) for iron-base compacts. The amount and depth of penetration of carbon introduced into a preform of a particular composition during carburization in an atmosphere of given carbon potential will principally depend on the heating temperature and the time-at-temperature. For a desired case depth and carbon concentration, time-at-temperature may, in general, vary inversely with temperature. Thus, it may be possible to carburize at a relatively low temperature if the time-at-temperature is prolonged, and relatively short carburizing times may be used when the carburizing temperature is high. So that relatively simple and less costly furnaces may be used, a carburizing temperature in the range of 1400° F. (760° C.) to 1800° F. (982° C.) is preferred. An alternative to heating in a carburizing furnace is to introduce carbon into the preform in a resinter operation by resintering in a carbon-rich atmosphere. In such case, cooling at a rate suitable to form bainite in at least a surface region of the preform follows the resinter operation.

Other means may be used to provide a sufficient amount of carbon in regions of the preform so that bainite will form when cooling at a suitable rate from a resintering temperature. For example, a suitable level of carbon may be included in the initial metallurgical powder, or appropriate levels of alloying elements promoting formation of bainite may be included in the powder. In many cases, a suitable carbon level in the powder to form bainite on cooling will be in the range of 0.25 up to 1.0 weight percent depending on the nature and amount of other elements in the metallurgical powder. Elements promoting formation of bainite include, for example, chromium, nickel, molybdenum, and manganese. If the carbon level in the initial metallurgical powder is too high, however, the toughness of the compact may be unacceptably low. Therefore, it is preferred to include a carburizing step in the method of the present invention in order to add suitable additional carbon to surface regions of the preform without unacceptably compromising toughness. Nevertheless, it will be understood that the carburizing step is unnecessary if carbon in an amount suitable to form bainite, given the overall composition of the particular metallurgical powder, is present in surface regions of the preform.

The preform is subsequently subjected to a resintering step wherein the preform is heated at high temperature for a predetermined period to further densify the compact. In the case of an iron-base preform, the resinter step may include, for example, heating the preform in an inert atmosphere or vacuum at a temperature in the range of 1400° F. (760° C.) to 2400° F. (1316° C.) for 10–60 minutes. Preferably, the resinter temperature is in the range of 2000° F. (1093° C.) to 2400° F. (1316° C.). Possible inert atmospheres include vacuum, argon gas, endogas, and a mixture of 0–100 parts by volume hydrogen and 100 parts by volume nitrogen. Other suitable inert atmospheres will be apparent to those of ordinary skill upon considering the present description of the invention.

Once the preform has been maintained at the resintering temperature for a suitable time, it is then cooled at a rate suitable to form bainite in one or more surface regions of the preform that may be subjected to shaving in a subsequent step. The appropriate cooling rate will depend on several factors including the composition of the initial metallurgical powder, the carbon content of the surface regions of the preform, and the temperature from which cooling is commenced. Those of ordinary may ascertain, without undue experimentation, a suitable cooling regimen to produce suitable bainite within surface regions of the gear that may be subjected to a shaving operation.

The inventors originally intended the resintering step to enhance the toughness of the finished gear. However, the inventors unexpectedly discovered that gears produced by shaving the gear teeth of a powder metal gear preform having a bainitic microstructure are of higher quality (as assessed by the DIN 3962 standard) than gears produced in a conventional manner from wrought bar stock. For example, the inventors produced external helical gears of DIN 3962 quality grade 5 by shaving the gear teeth of a powder metal gear preform that was provided with a bainitic microstructure in the shaved regions by resintering and cooling the preform at a rate suitable to produce bainite. In contrast, external helical gears produced by the conventional method generally shown in FIG. 1 were of DIN 3962 quality grade 7 when the hobbed gear teeth were shaved, or quality grade 8 when the hobbed gear teeth were rolled.

Figure 1:
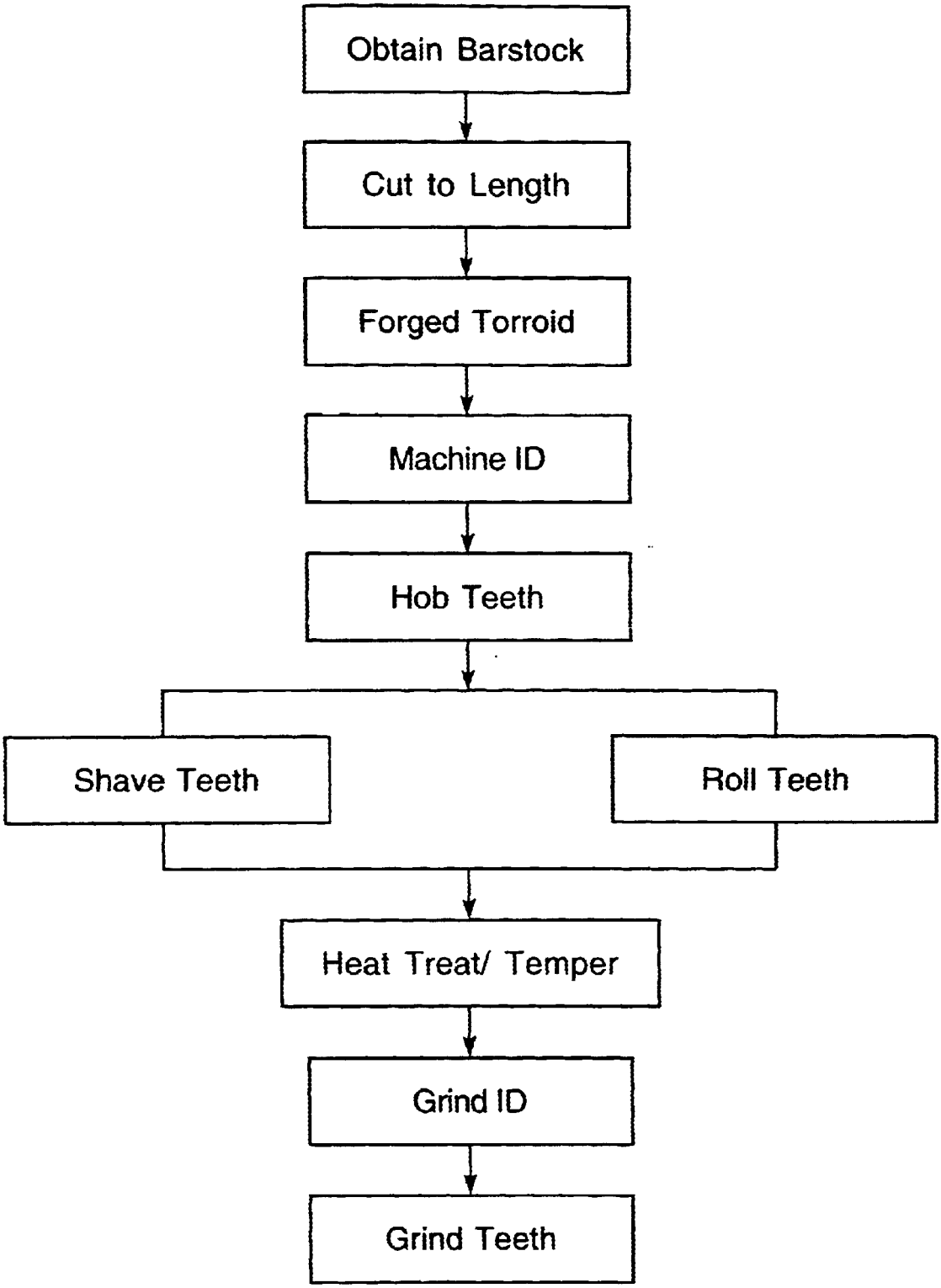
FIG. 1 Prior Art
FIG. 1 is a schematic representation of an embodiment of a prior art process for producing external helical gears from wrought steel bar stock.

The difference in quality between gears produced by the conventional method shown in FIG. 1 and the embodiment of the present method shown in FIG. 2 is substantial. Without intending to be limited to any particular theory of operation, is believed that the difference in quality may be in some part attributable to the difference in the microstructure of the regions that have been shaved (or rolled). Shaved regions of gears produced by the conventional method were found to exhibit a microstructure including islands of pearlite and large areas of ferrite. The bainitic microstructure of the shaved regions of powder metal gears produced by the embodiment of FIG. 2 is substantially more uniform than the microstructure of the wrought material. This may result in a more consistent load on the shaving tools, preventing a shingling effect on the shaved surface of the powder metal gears that was seen on the shaved surface of the wrought gears. The bainitic material may be less likely to weld to the shaving tool than is the less uniform ferrite/pearlite material of the wrought gears. A reduced tendency of the powder metal material to weld to the shaving tool may improve the resulting gear surface and increase the lifespan of the shaving tool.

Subsequent to the resintering and cooling steps, the gear preforms may be shaved to adjust dimensions and improve uniformity. As just noted, shaving gear preforms produced according to embodiments of the method of the present invention can produce gears of quality grade 5 or better.

Subsequent to the shaving step, gears produced according to the present invention may be heat treated and honed in a conventional manner, as is suggested in FIG. 2. Other conventional techniques also may be used to improve or otherwise adjust properties of the gears as desired. The heat treating, honing, and other additional steps may be selected by one of ordinary skill in the art in light of the particular requirements for the finished gear, and it will be understood that such steps are not required steps of the present methods. As such, no further description of post-shaving steps is provided herein.

A comparative example of gears produced by the method of the present invention and by a conventional method from wrought bar stock follows.

EXAMPLE

A powder metal external helical gear for automotive applications was produced by a method within the present invention from a powder mix having the following elemental analysis, all values in weight percentages: about 0.25 carbon; about 0.09 sulfur; about 0.012 phosphorus; about 0.2 manganese; about 0.55 molybdenum; about 1.8 nickel; about 0.003 silicon; about 0.05 chromium; about 0.02 copper; and remainder iron and incidental impurities. A portion of the powder was pressed at 40 tsi in a hydraulic mold press to form a gear preform in the shape of the external helical gear. The preform was then sintered at 2050° F. (1121° C.) for 20 minutes time-at-temperature in an electric-fired belt sintering furnace. The sintered preform was cooled to room temperature, coated with graphite lubricant, heated to 1800° F. (982° C.), and then hot formed at 55 tsi in a hot forming die heated to 600° F. (316° C.). The hot formed preform was then placed in a carburizing furnace in a 1.1% carbon endogas atmosphere at 1700° F. (927° C.) for 150 minutes. The carburizing step increased the carbon content of surface regions of the preform to approximately 0.9%. After the carburized preform cooled to room temperature, it was resintered by heating at 2300° F. (1260° C.) in an atmosphere of 94 volume % nitrogen and 6 volume % hydrogen for 20 minutes. The hot preform was then cooled at about 120° F./minute (66.7° C./minute) by atmospheric convection. The gear teeth were then shaved in a conventional manner.

The quality of the resulting external helical powder metal gear was evaluated under the DIN 3962 standard. The gear rated a quality grade 5. The microstructure of a region of the powder metal gear exposed by the shaving operation, shown taken at 500× magnification in FIG. 3, was bainitic.

A gear of similar overall chemistry and geometry was produced by machining a forged torroidal blank produced from a section of wrought bar stock by the method generally shown in FIG. 2. The gear teeth were shaved in the manner used with the powder metal gear, and the quality of the gear was evaluated in a similar fashion under the DIN 3962 standard after the shaving step. The gear rated a quality grade of 7. Inspection of the microstructure of a region of the wrought gear exposed by the shaving step, shown taken at 500× magnification in FIG. 4, revealed that the microstructure consisted of islands of pearlite in large areas of pearlite and was less uniform than the bainitic microstructure of the exposed surface of the powder metal gear.

Whereas particular embodiments of the invention have been described herein for the purpose of illustrating the invention and not for the purpose of limiting the same, it will be appreciated by those of ordinary skill in the art that numerous variations of the details, materials, and arrangement of steps and parts may be made within the principle and scope of the invention without departing from the invention as described in the appended claims.

What is claimed is:

1. A method of producing a gear from a metallurgical powder, the method comprising:

molding at least a portion of an iron-base metallurgical powder to provide a gear preform;

sintering the gear preform;

hot forming the gear preform carburizing the gear preform;

resintering the gear preform; and cooling the gear preform at a cooling rate that provides a bainitic microstructure in at least a surface region of the gear preform.

2. The method of claim 1, further comprising, subsequent to cooling the gear preform at a cooling rate that provides a bainitic microstructure in at least a surface region of the gear preform:

shaving the gear preform to provide the gear.

3. The method of claim 2, wherein immediately after shaving the gear preform the gear is of quality at least as great as grade DIN 5.

4. The method of claim 1, wherein the iron-base metallurgical powder includes, in weight percentages: 0.2 up to 0.3 carbon; 0 up to 0.2 sulfur; up to 0.03 phosphorus; 0.10 up to 0.25 manganese; 0.50 up to 0.60 molybdenum; 1.75 up to 2.00 nickel; 0 up to 0.03 silicon; 0 up to 0.10 chromium; 0 up to 0.15 copper; and iron.

5. The method of claim 4, wherein the iron-base metallurgical powder includes, in weight percentages: about 0.25 carbon; about 0.09 sulfur; about 0.012 phosphorus; about 0.2 manganese; about 0.55 molybdenum; about 1.8 nickel; about 0.003 silicon; about 0.05 chromium; about 0.02 copper; and iron.

6. The method of claim 1, wherein the gear is one of an external helical gear and an external straight gear.

7. The method of claim 1, wherein molding a portion of the iron-base metallurgical powder comprises:

disposing the portion of the metallurgical powder in a preform mold including a gear-shaped mold cavity and a movable member; and impacting the portion of the metallurgical powder with the movable member to provide the gear preform.

8. The method of claim 7, wherein impacting the portion of the metallurgical powder comprises applying 20 up to 70 tsi pressure to the portion within the gear-shaped mold cavity.

9. The method of claim 7, wherein:

the movable member is a rotating punch member;

and impacting the portion of the metallurgical powder includes axially impacting the portion of the metallurgical powder in the preform mold with the rotating punch member to provide a helical gear preform.

10. The method of claim 9, wherein the mold press includes a core rod that passes through the mold cavity and forms a bore through the gear preform.

11. The method of claim 10, wherein the core rod has a desired gear profile on an exterior surface thereof, and further wherein impacting the portion of the metallurgical powder includes rotating the core rod to provide an internal helical gear preform.

12. The method of claim 1, wherein hot forming the gear preform comprises:

placing the gear preform in a hot forming mold including a gear-shaped mold cavity and a movable member; and impacting the gear preform with the movable member to provide a densified gear preform.

13. The method of claim 1, wherein sintering the gear preform comprises:

heating the gear preform at 2000° F. (1093° C.) up to 2400° F. (1315° C.) for a predetermined time.

14. The method of claim 1, wherein hot forming the gear preform comprises:

disposing the gear preform in a heated hot forming die; and applying 20 up to 70 tsi pressure to the gear preform.

15. The method of claim 1, wherein carburizing the gear preform comprises:

heating the gear preform at 1400° F. (760° C.) up to 1800° F. (982° C.) in a carbon-containing atmosphere.

16. The method of claim 1, wherein resintering the gear preform comprises:

heating the gear preform at 2000° F. (1093° C.) to 2400° F. (1315° C.) for 10–30 minutes in an inert atmosphere.

17. The method of claim 1, further comprising, subsequent to shaving the gear preform:

heat treating the gear to increase hardness.

18. A method for producing a gear from metallurgical powder, the method comprising:

molding at least a portion of an iron-base metallurgical powder in a gear-shaped mold cavity to provide a gear preform;

sintering the gear preform;

hot forming the gear preform;

resintering the gear preform;

cooling the gear preform to provide a bainitic microstructure in at least a surface region of the gear preform; and shaving the gear preform to provide a gear.

19. The method of claim 18, wherein immediately after shaving the gear preform the gear is of quality at least as great as grade DIN 5.

20. The method of claim 18, wherein the gear is one of an external helical gear, an internal helical gear, an external straight gear, and an internal straight gear.

21. The method of claim 18, wherein hot forming the gear preform comprises:

disposing the gear preform in a heated hot forming die; and applying 20 up to 70 tsi pressure to the gear preform.

22. The method of claim 18, wherein resintering the gear preform comprises:

heating the gear preform at 2000° F. (1093° C.) up to 2400° F. (1315° C.) for 10–30 minutes in an inert atmosphere.

23. A method of producing a powder metal gear, the method comprising:

molding an iron-base metallurgical powder to a gear preform;

sintering the gear preform;

hot forming the gear preform;

resintering the gear preform; and forming a bainitic microstructure in at least a surface region of at least a portion of the gear preform to provide the gear.

24. The method of claim 23, further comprising, intermediate hot forming the gear preform and resintering the gear preform:

increasing carbon content in at least a surface region of at least a portion of the gear preform.

25. The method of claim 23, further comprising, subsequent to cooling the gear preform: shaving the gear.

26. The method of claim 23, wherein the iron-base metallurgical powder includes, in weight percentages: 0.2 up to 0.3 carbon; 0 up to 0.2 sulfur; up to 0.03 phosphorous; 0.10 up to 0.25 manganese; 0.50 up to 0.60 molybdenum; 1.75 to 2.00 nickel; 0 up to 0.03 silicon; 0 up to 0.10 chromium; 0 up to 0.15 copper; and iron.

* * * * *

UNITED STATES PATENT AND TRADEMARK OFFICE

CERTIFICATE OF CORRECTION

PATENT NO. : 6,630,101 B2
DATED : October 7, 2003
INVENTOR(S) : Anderson et al.

Figure 3:
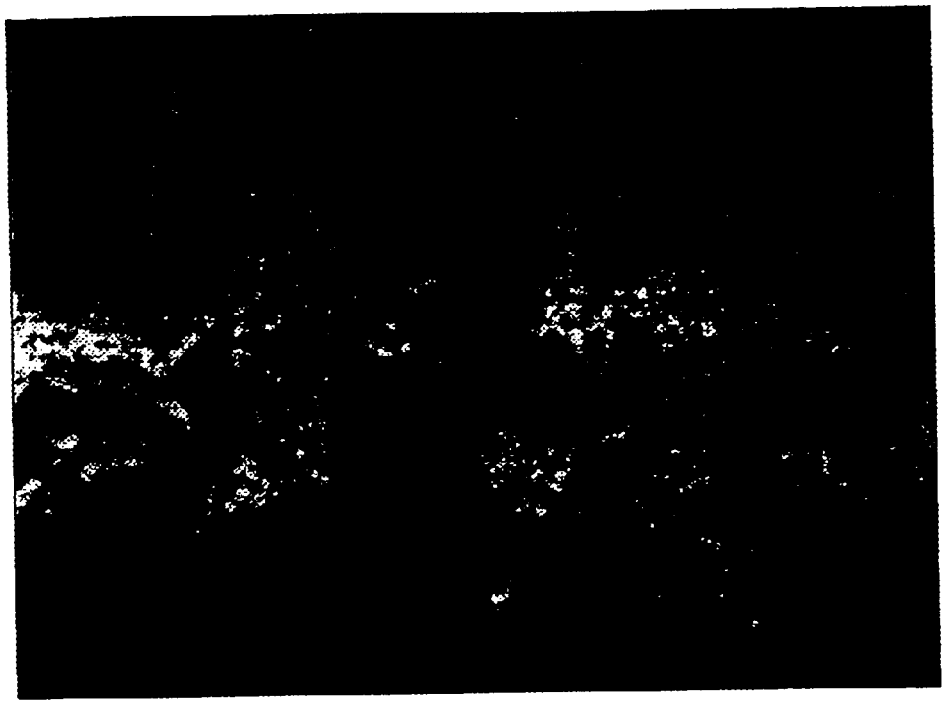
FIG. 3 is a photomicrograph taken at 500× magnification showing the microstructure of a region of a powder metal external helical gear produced by an embodiment of the method of the present invention.
Figure 4:
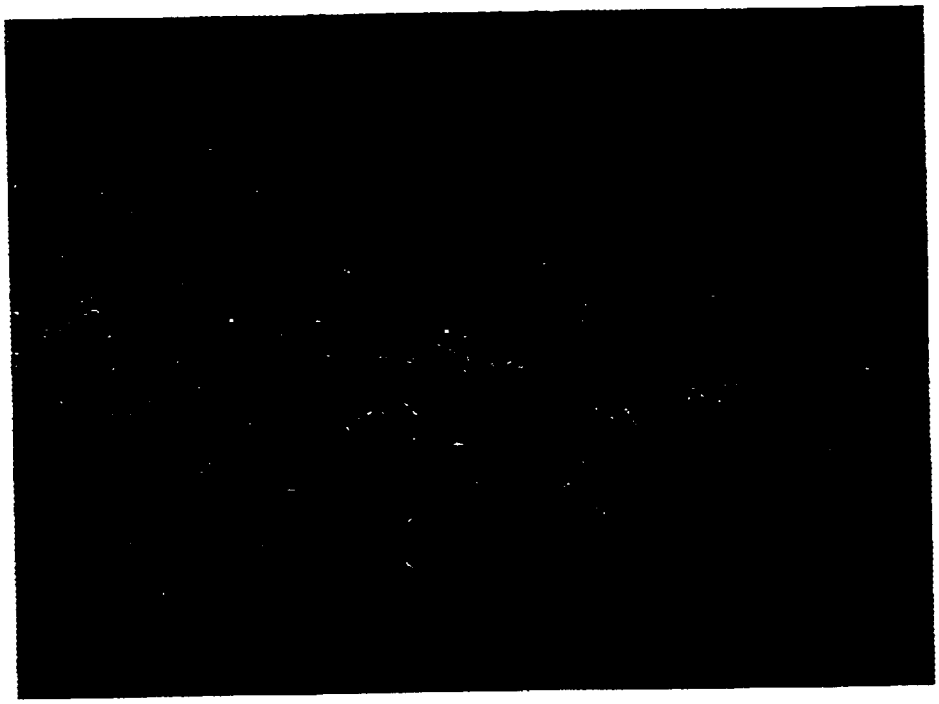
FIG. 4 is a photomicrograph taken at 500× magnification showing the microstructure of a region of an external helical gear produced from wrought bar stock using a conventional method.
Figure 3:
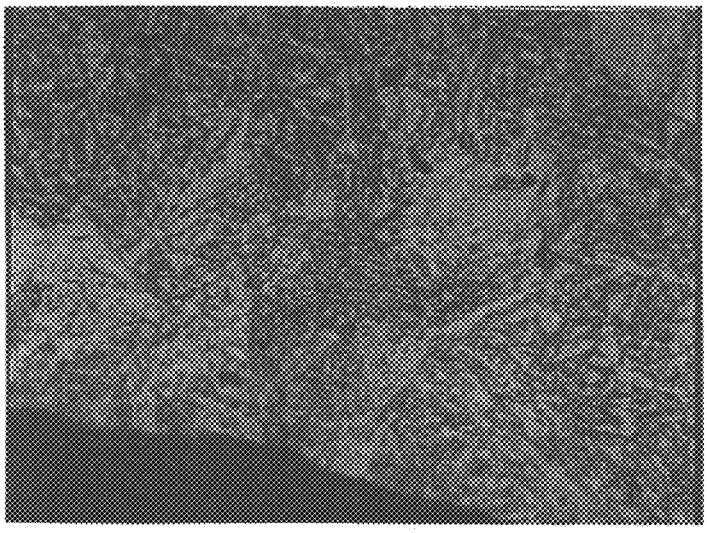
Figure 4:
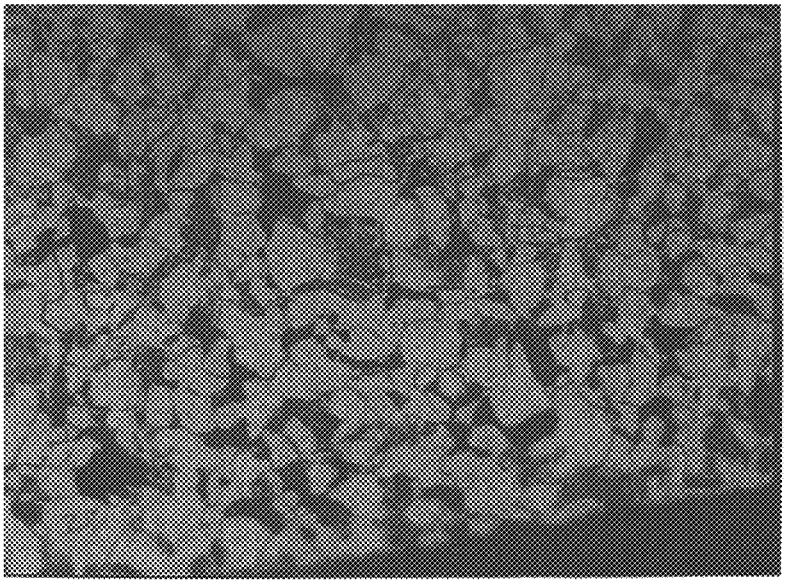

It is certified that error appears in the above-identified patent and that said Letters Patent is hereby corrected as shown below:

Drawings,
Sheet 3 of 3, please delete the photomicrograph immediately above the labels on FIGS. 3 and 4, and replace with the attached drawings.

Column 1,
Line 51, please delete “form” and replace with -- from --.

Column 3,
Line 3, please delete “particular” and replace with -- particularly --.
Line 5, insert the word -- of --, before “machinery”

Column 10,
Line 16, please insert a -- ; -- immediately after the word “preform”.

Signed and Sealed this

Ninth Day of March, 2004

JON W. DUDAS
*Acting Director of the United States Patent and Trademark Office*